United States Patent [19]

Roccaforte

[11] 4,417,678

[45] Nov. 29, 1983

[54] CARTON OPENING DEVICE

[75] Inventor: Harry I. Roccaforte, Western Springs, Ill.

[73] Assignee: Champion International Corporation, Stamford, Conn.

[21] Appl. No.: 299,958

[22] Filed: Sep. 8, 1981

[51] Int. Cl.[3] ..... B65D 85/671

[52] U.S. Cl. ..... 225/43; 206/395; 206/628; 225/48; 225/50

[58] Field of Search ..... 225/48–50, 225/43, 53; 206/395, 396, 608, 611–613, 624–626, 628, 629, 631

[56] References Cited

U.S. PATENT DOCUMENTS

| | | | |
|---|---|---|---|
| 2,114,134 | 4/1938 | Weiss | 206/631 X |
| 2,115,673 | 4/1938 | Stompe | 206/608 X |
| 2,683,641 | 7/1954 | Larson | 225/43 X |
| 2,803,339 | 8/1957 | Kuchenbecker | 206/628 X |
| 3,002,667 | 10/1961 | Buttery | 206/631 X |
| 3,137,424 | 6/1964 | Finn et al. | 225/49 X |
| 3,563,451 | 2/1971 | Rosenburg, Jr. | 206/631 X |
| 3,733,025 | 5/1973 | Hiersteiner | 206/628 X |
| 3,933,288 | 1/1976 | Struble | 225/49 |
| 3,974,947 | 8/1976 | Budny | 225/25 |
| 4,307,828 | 12/1981 | Sias et al. | 225/43 X |

*Primary Examiner*—Frank T. Yost

*Attorney, Agent, or Firm*—Evelyn M. Sommer; William W. Jones

[57] ABSTRACT

A one-piece carton blank is erected into a carton containing a sheet of material rolled on a spool, the carton having a liftable top panel which is connected to a hood panel. The hood panel has a cutting edge, for example, a metal serrated strip protruding from its free edge, to tear the selected length of the sheet material. When the carton is closed the hood panel lies against the front panel of the carton. The carton is opened by the user inserting a finger through one, or preferably two, orifices in the hood panel and pushing against the front panel to break adhered areas and thereby free the hood from the front panel. The hood may have one or more liftable strips formed by parallel breakable score lines, the strips terminating at the orifice.

10 Claims, 4 Drawing Figures

CARTON OPENING DEVICE

BACKGROUND OF THE INVENTION

The present invention relates to paperboard cartons and more particularly to the construction of the opening mechanism for elongated cartons.

At the present time rolls of sheet materials are often packaged in elongated paperboard cartons. For example, the consumer may purchase an elongated sheet of aluminum foil, waxed paper, plastic wrapping material, joined flat plastic bags, or other sheet-like materials, which are wound about a hollow tubular paperboard spool. The sheet-like material, wound on the tube, is packaged in a paperboard carton, which is generally an elongated carton. The carton is generally rectangular in cross-section and has a top openable cover member having a hood, the hood extending partially over the front panel of the carton.

A metal cutting strip having an exposed serrated edge is attached to the free end of the carton's hood or along the base (bottom edge) of the carton. The cutting strip is used to tear the material rolled within the carton. For example, a consumer will open the carton, pull out the desired length of sheet material, such as waxed paper, and tear off the removed length of sheet material by pulling the material against the serrated edge of the metal strip.

In one type of elongated carton the cover member is held closed and sealed by a removable strip formed by two parallel breakable score lines. The customer, to open the carton, lifts a free end of the paperboard strip, pulls the strip away from the carton and separates it from the carton. However, sometimes the strip, when pulled, may break or tear, leaving the carton still closed. In that situation, it may be difficult to raise the still-secured portion of the strip and pull it away from the carton. In addition, when the paperboard strip is pulled, it exposes the serrated edge of the metal cutting edge. That edge, which may be located at the base of the carton, may be sharp and may cut the user's finger as the user pulls on the paperboard tear strip.

OBJECTIVES AND FEATURES OF THE INVENTION

It is an objective of the present invention to provide an elongated carton, and the one-piece carton blank from which the carton is erected, in which the carton is adapted for the packaging of sheet material wound upon an elongated tubular spool and having an attached cutting edge and in which the carton may be conveniently opened by the consumer.

It is a further objective of the present invention to provide such a carton which may be opened without danger to the user's fingers from the cutting edge.

It is a further objective of the present invention to provide such a carton, and carton blank, which may be manufactured relatively economically using conventional carton making and assembling machinery.

It is a further objective of the present invention to provide such a carton which may be opened without the likelihood of damaging the hood and may be reclosed, after being opened, using the hood of the carton.

It is a feature of the present invention to provide a one-piece carton blank and the paperboard carton which is erected from that blank, the carton being adapted to enclose material, such as plastic film, aluminum foil and plastic bags, rolled upon a spool within the carton. The carton comprises a series of panels formed from a one-piece carton blank and connected along articulated lines. These panels form front and back panels, two opposite end panels, a bottom panel and a top panel which is hinged to the front panel. A hood panel is connected to the top panel and lies flat against the front panel when the carton is closed.

A cutting edge strip, such as a metal strip having a serrated edge, is attached to the free edge of the hood panel and projects beyond its free edge. After the carton has been opened, the selected length of the sheet material may be pulled from the carton and torn against the cutting edge. The carton further comprises a plurality of adhesive areas joining the hood and the front panel and at least one orifice, and preferably two, in the hood of sufficient size to permit finger entry. The orifice is located adjacent the adhesive areas so that finger pressure through the orifice and against the front panel will break the jointure of the adhesive areas and separate the hood from the front panel.

BRIEF DESCRIPTION OF THE DRAWINGS

Other objectives and features of the present invention will be apparent from the following detailed description which, when taken in conjunction with the accompanying drawings, provides the inventor's best mode of practicing the invention.

In the drawings.

DETAILED DESCRIPTION OF THE INVENTION

The carton of the present invention is manufactured from a one-piece paperboard blank, for example, of coated cardboard. The paperboard blank may be manufactured using conventional high-speed carton blank manufacturing machines and may be erected (assembled) using conventional machines.

Figure 1:
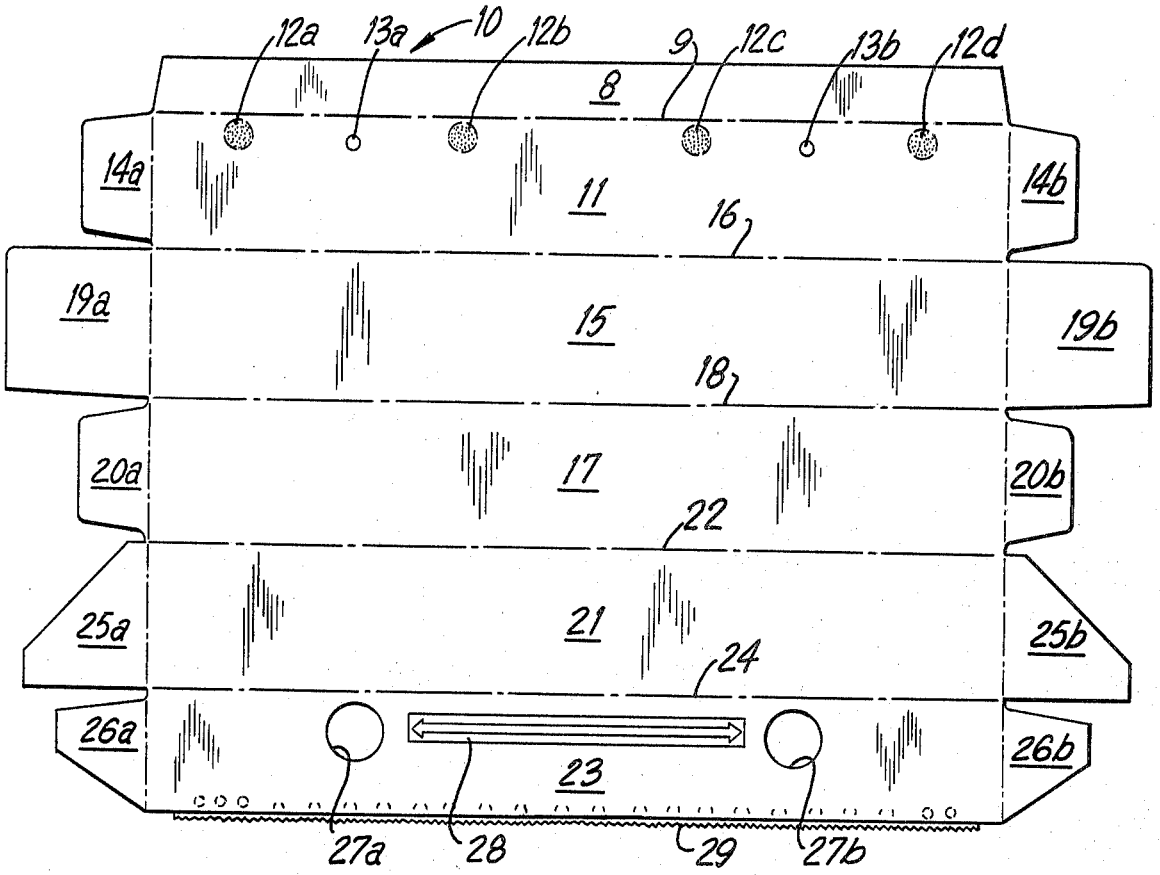
FIG. 1 is a top plan view of the one-piece carton blank of the first embodiment of the present invention.

The one-piece paperboard blank 10 of the first embodiment, as shown in FIG. 1, comprises a series of panels which are joined along articulated fold lines. The front panel 11, shown at the top of FIG. 1, has on its upper face four adhesive areas 12*a* through 12*d*. Two printed areas 13*a* and 13*b* are positioned between the adhesive areas 12*a*, and 12*b* and 12*c*, 12*d* respectively. The front panel 11 has opposite side flaps 14*a* and 14*b* connected to it by fold lines and is connected to the lip panel 8 by the fold line 9.

The front panel 11 is connected to the bottom panel 15 by the fold line 16 and the bottom panel is connected to the back panel 17 by the fold line 18. A second pair of side flaps 19*a*,19*b* are connected to the bottom panel 15 at its opposite sides by fold lines. Similarly, a third pair of side flaps 20*a* and 20*b* are connected by fold lines at opposite sides of the back panel 17. The back panel 17 is connected to the top panel 21 by a fold line 22.

The top panel 21 is connected to the hood panel 23 by a fold line 24. A fourth pair of flaps 25*a*, 25*b* is joined by fold lines at the opposite sides of the top panel 21. A fifth pair of side flaps 26*a*, 26*b* is connected by fold lines at the opposite sides of the hood panel 23.

The hood panel has two round orifices 27*a*, 27*b* which are aligned with the respective printed areas 13*a* and 13*b*. A printed indication 28 on hood panel 23 provides instructions to the user and says: "To open: press both dots to break seal . . . then lift lid". It has arrows pointing towards the respective orifices 27*a*, 27*b*. The orifices 27*a*, 27*b* of the hood panel 23 are sufficiently large in size so that the user's fingers may protrude through those orifices.

An elongated strip of metal 29, preferably having a serrated edge, is connected along the free edge of the hood panel 23 with its cutting edge protruding beyond the paperboard of the hood panel 23.

Figure 2:
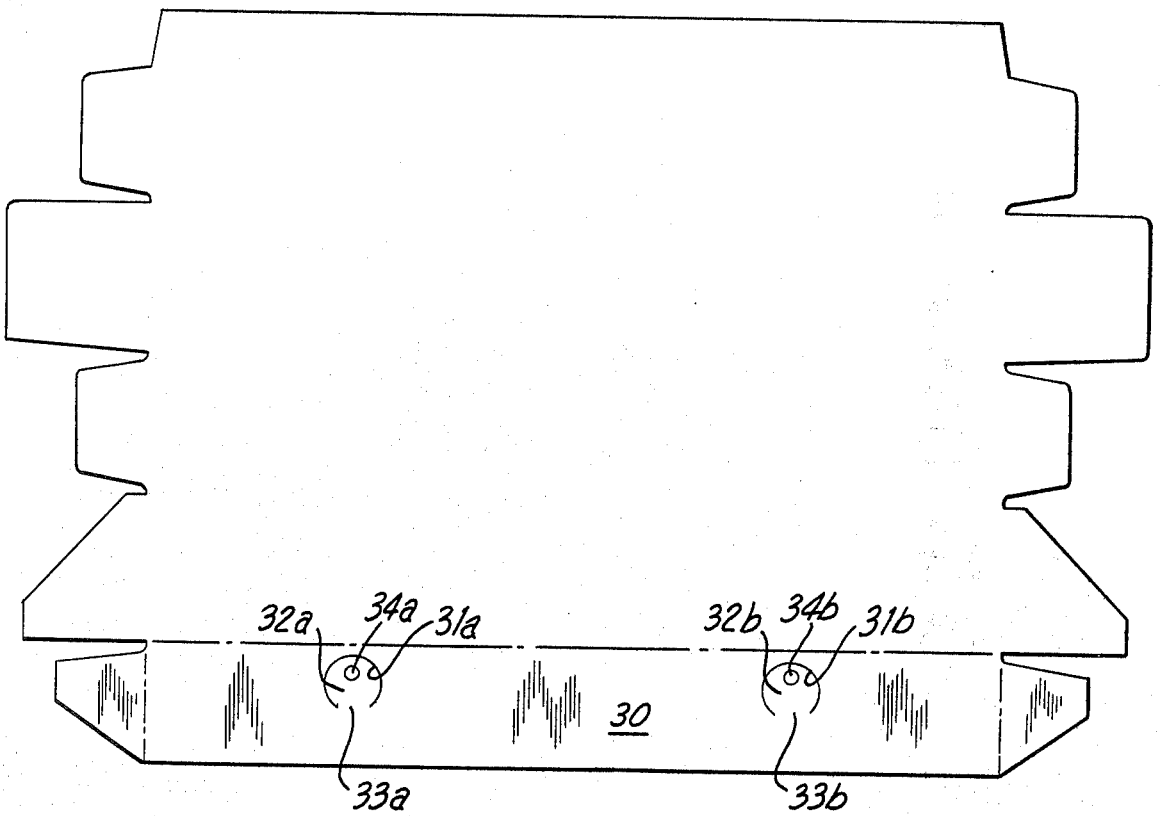
FIG. 2 is a top plan view of the hood panel of the second embodiment of the present invention.
Figure 3:
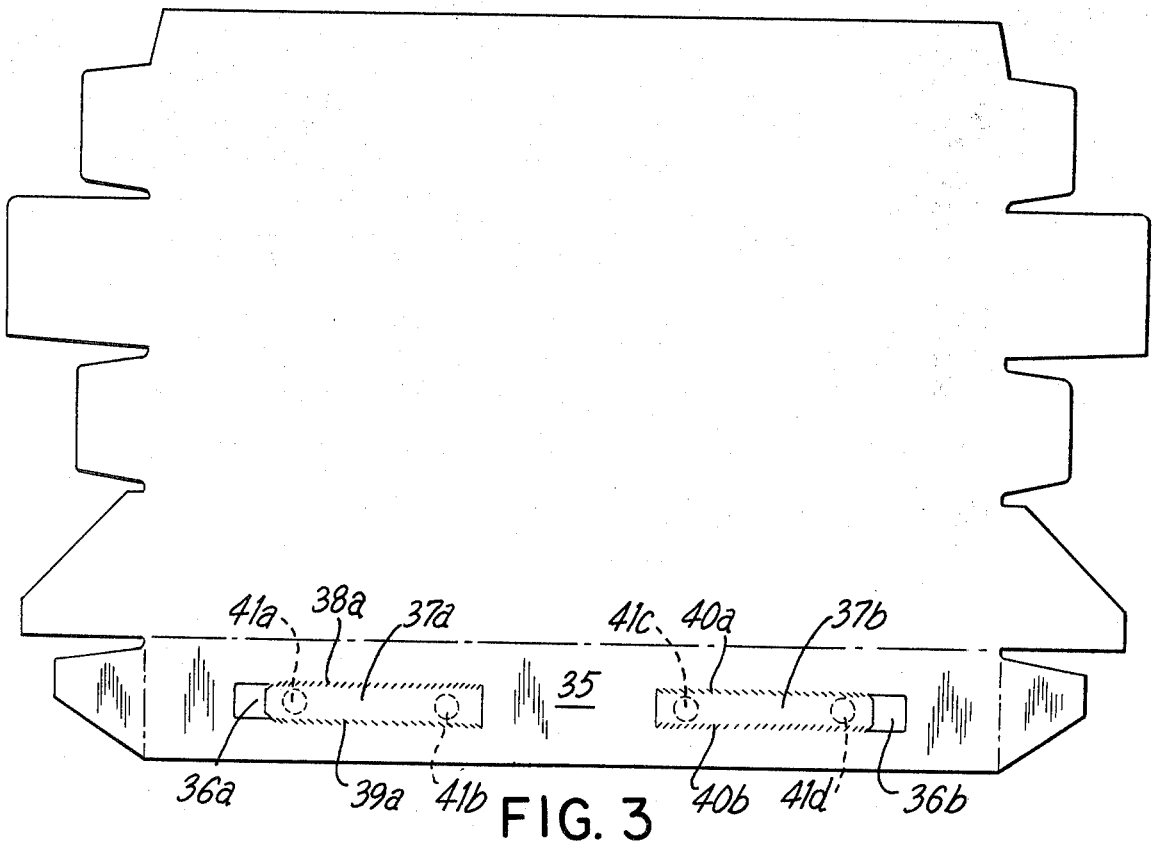
FIG. 3 is a top plan view of the hood panel of the third embodiment of the present invention.

The second and third embodiments, as shown respectively in FIGS. 2 and 3, are similar in all respects to the embodiment of FIG. 1 except for their hood panels.

As shown in FIG. 2, the hood panel 30 has two orifices 31*a*, 31*b* which are round in shape. Round tabs 32*a*, 32*b* are positioned within the respective orifices 31*a*, 31*b*. The tabs are cut so they are free to move inwardly with respect to the plane of the hood panel 30. The tabs 32*a*, 32*b* are attached to the hood panel 30 by a small uncut portion 33*a*, 33*b* of the cut circle forming the respective tabs 32*a*, 32*b*. Each of the tabs has printed thereon a dot 34*a*, 34*b*, respectively. Instructions on the hood panel has oppositely pointing arrowheads and states: "To open: press both dots to break seal . . . then lift lid".

In the third embodiment, as shown in FIG. 3, the hood panel 35 has orifices 36*a*, 36*b*, respectively, which are rectangular in shape. The orifices 36*a*, 36*b*, as in the case of the orifices of the first and second embodiments, are sufficiently large in size to permit the entry of the user's fingers. Paperboard strips 37*a*, 37*b* are formed on hood panel 35 between breakable score lines 38*a*, 39*a* (in the case of strip 37*a*) and breakable score lines 40*a*, 40*b* (in the case of strip 37*b*). The strips 37*a*, 37*b* terminate, at their free ends, at the respective orifices 36*a*, 36*b*. When the carton is erected the strips 37*a*, 37*b* cover the adhesive areas 12*a*–12*d* on the front panel 11. The positions of those adhesive areas on the strips 37*a*, 37*b* are indicated by the circular dash lines 41*a*–41*d*.

The carton is erected from the blank of FIG. 1 by folding along its various fold lines and adhering the side flaps. The side flaps 14*b* and 20*b* are adhered with their outer faces (the top side of the blank as seen in FIG. 1) adhered to the inner face (bottom side of blank) of flap 19*b*. Similarly, side flaps 14*a*, 10*a* are adhered to the flap 19*a*. The outer face of flap 26*b* is adhered to the inner face of flap 25*b* and similarly the flap 26*a* is adhered to the flap 25*a*. The contents, such as sheet material rolled on a tubular spool, is inserted and the carton is sealed by the adhesive areas 12*a*–12*d* adhering the front panel 11 to the hood panel 23.

Figure 4:
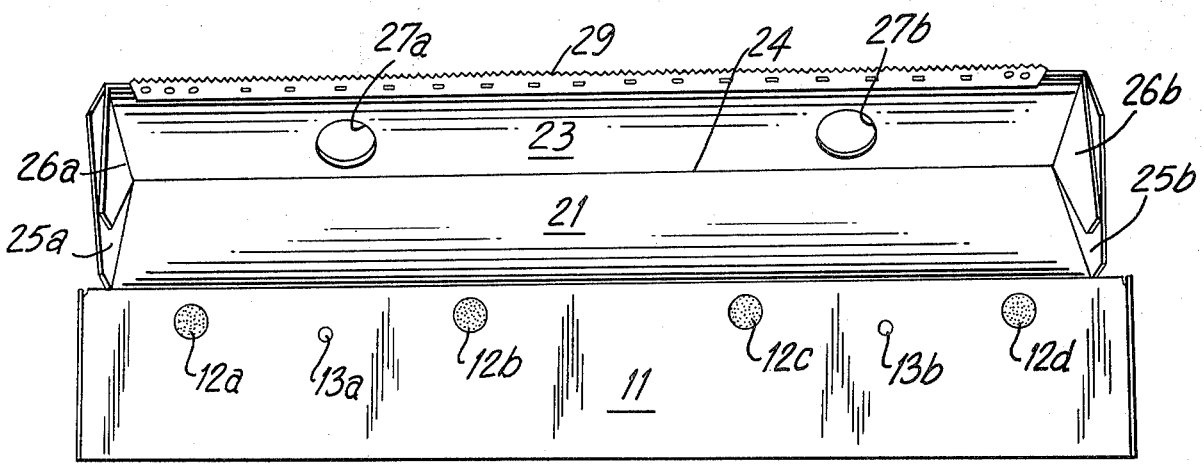
FIG. 4 is a perspective view of the erected carton of the first embodiment of the present invention after it has been opened.

When the consumer wishes to open the carton, in the embodiment of FIGS. 1 and 4, she places her fingers through the orifices 27*a*, 27*b* and pushes on the front panel, thereby breaking the jointure formed by the adhesive areas 12*a*–12*d*. In the embodiment of FIG. 2 she would push on the tabs, also thereby breaking the jointure of the adhesive areas 12*a*–12*d*. In the case of the embodient of FIG. 3 she places a finger through the orifice 36*a* and lifts the strip 37*a*, thereby breaking the jointure of the adhesive areas adhered to the strip 37*a*. In all embodiments, when the adhesive areas are broken the hood panel may be lifted without touching the cutting edge.

What is claimed is:

1. A paperboard carton adapted to enclose material rolled upon a spool within the carton, said carton comprising:

a series of panels formed from a one-piece carton blank and connected along articulated lines, said panels forming front and opposite back panels, two opposed end panels, a bottom panel and a top panel hinged to the back panel;

a hood panel connected to said top panel and lying flat against said front panel when the carton is closed;

a cutting edge strip attached to a free edge of said hood panel and projecting beyond said free edge so that the material may be torn against the cutting edge strip after the carton is opened; and a plurality of adhesive areas joining the hood panel and the front panel and at least one orifice in said hood panel of sufficient size to permit finger entry and located adjacent said adhesive areas so that finger pressure through said orifice against said front panel will break the jointure of said adhesive areas and separate the hood panel from the front panel.

2. The carton of claim 1 wherein there are at least two orifices in said hood panel of sufficient size to permit finger entry.

3. The carton of claim 1 and further comprising a flap cut from said hood panel and within said orifice.

4. The carton of claim 1 wherein said orifice is round.

5. A paperboard carton adapted to enclose material within the carton, said carton comprising:

a series of panels formed from a one-piece carton blank and connected along articulated lines, said panels forming front and opposite back panels, two opposed end panels, a bottom panel and a top panel hinged to the back panel;

a hood panel connected to said top panel and lying flat against said front panel when the carton is closed; and a plurality of adhesive areas joining the hood panel and the front panel and at least one orifice in said hood panel of sufficient size to permit finger entry and located adjacent said adhesive areas so that finger pressure through said orifice against said front panel will break the jointure of said adhesive areas and separate the hood panel from the front panel.

6. The carton of claim 5 wherein there are at least two orifices in said hood panel of sufficient size to permit finger entry.

7. The carton of claim 5 and further comprising a flap cut from said hood panel and within said orifice.

8. A one-piece integral paperboard carton blank adapted to be erected into a carton to enclose material rolled upon a spool within the carton, said carton blank comprising:

a series of panels forming said one-piece carton blank and connected along articulated lines, said panels being, in order, a front panel, a bottom panel, a back panel and a top panel, and flaps connected to said panels to form opposite ends of said carton;

a hood panel connected to said top panel, which hood panel lies flat against said front panel when the carton is erected and closed;

a cutting edge strip attached to the free edge of said hood panel and projecting beyond it so that the material may be torn against the cutting edge after the carton is opened; and a plurality of adhesive areas to join the hood panel and the front panel and at least one orifice in said hood panel of sufficient size to permit finger entry so that, after the carton is erected and closed, finger pressure through said orifice against said front panel will break the jointure of said adhesive areas and separate the hood panel from the front panel.

9. A paperboard carton blank as in claim 8 wherein there are at least two orifices in said hood panel of sufficient size to permit finger entry.

10. A paperboard carton blank as in claim 8 and further comprising a flap cut from said hood panel and within said orifice.

* * * * *